US005910377A

United States Patent [19]

Tsukamoto et al.

[11] Patent Number: 5,910,377

[45] Date of Patent: Jun. 8, 1999

[54] CLAD STEEL PLATE

[75] Inventors: Katsuro Tsukamoto, Osaka; Susumu Ishikawa, Tokyo, both of Japan

[73] Assignees: Shinsozaihanbai Kabushiki Kaisha, Osaka; Akiyama Gasket Kabushiki Kaisha, Tokyo, both of Japan

[21] Appl. No.: 08/796,267

[22] Filed: Feb. 7, 1997

[51] Int. Cl.[6] ..... B32B 15/18; B32B 5/00; B32B 3/06

[52] U.S. Cl. ..... 428/609; 428/614; 428/645; 428/659; 428/684; 428/685

[58] Field of Search ..... 428/457, 464, 428/544, 597, 596, 684, 619, 644, 648, 653, 659, 667, 676, 677, 679, 680, 594, 598, 609, 614, 645, 685; 228/115–117, 136

[56] References Cited

U.S. PATENT DOCUMENTS

| | | | |
|---|---|---|---|
| 312,485 | 2/1885 | Makin | 428/609 |
| 1,323,167 | 11/1919 | Denny | 205/150 |
| 2,274,765 | 3/1942 | Zalkind | 428/464 |
| 2,490,548 | 12/1949 | Schultz | 428/609 |
| 3,781,971 | 1/1974 | Middleton | 228/115 |
| 4,023,613 | 5/1977 | Uebayasi et al. | 164/100 |

*Primary Examiner*—Mary E. Mosher
*Attorney, Agent, or Firm*—Curtis L. Harrington

[57] ABSTRACT

The present invention provides a clad steel plate of a base material and a cover material attached to the base material. The base material has holes with rising rims and the rims pass through the covering material and expand over its surface to unite the base and covering materials.

2 Claims, 4 Drawing Sheets

CLAD STEEL PLATE

FIELD OF THE INVENTION

The present invention relates to a clad steel plate and has an object to offer an easy-to-make and inexpensive-to-make clad steel plate with a high strength of cohesion.

PRIOR ART

Laminated steel plates formed by putting different metals together as represented by, for example, clad plate are used as excellent clad materials with combined characteristics of both metals in wide fields such as automobile parts, electric appliances for household use and articles for daily use.

The most common of all the processes used for manufacturing such clad steel plates is the hot rolling used to put together two metals, one placed on the top of another.

The hot rolling, however, is prone to cause an oxidation of the surfaces of contact. Once an oxidation takes place, it is impossible to obtain an adequate strength of cohesion between materials. To prevent an oxidation of the surfaces of contact, therefore, various measures are taken including realization of a seal weld along the peripheries of the surfaces to be put together. Yet, it has been technically difficult to butt-joint and thus hermetically weld the peripheries of two different metals.

On the other hand, a vacuum rolling process, i.e. a rolling done in a vacuum atmosphere, is being developed as a method to solve such problems.

But, this vacuum rolling process requires not only an extra equipment, needless to say, but also a long time to create a vacuum atmosphere. As such it was not a favorable process from the viewpoint of manufacturing cost.

The present invention which has been made in view of such conventional problems is intended to offer a clad steel plate with a high strength of cohesion readily and inexpensively manufactured.

SUMMARY OF THE INVENTION

A clad steel plate according to claim 1 which comprises a base material with holes with rising rims and a covering material both held fast together by the rising rims passing through the covering material and expanding over its surface will give the following effects:

Since the base material and the covering material are put together with the rising rims of the base material passed through the covering material and expanded over its surface, we can obtain a clad steel plate with a high strength of cohesion between the base material and the covering material.

It is possible to apply the clad steel plate according to the present invention as a product or component requiring a high heat barrier or insulation capacity in various fields including automobile parts such as engine head gasket or manifold gasket or parts of household articles such as water heater or air-conditioner etc.. In addition, the clad steel plate according to the present invention which is provided with a large number of holes can be used as sound-absorbing or -insulating material.

Besides, freely adjusting the thickness of the base material and of the covering material makes it possible to manufacture clad steel plates not only of various total thickness but also of various ratios of thickness between the base material and the covering material by making the base material thicker than the covering material or the other way around, i.e. the base material thinner than the covering material.

In addition, we can obtain materials with excellent workability in metallic mold even from aluminum or other unannealed materials which are otherwise liable to develop cracks during press forming in metallic mold by making a clad plate by combination with other materials. Moreover, although conventional pressings made of multiple materials have required a multiple number of pressing processes, the clad steel plate according to the present invention need be pressed just once and as such will prove extremely advantageous even in terms of the efficiency and cost of production.

Besides, although it has been difficult to weld some particular materials with a certain other type of metal, laying an excellently weldable covering material on the surface of a base material now makes it easy to weld them together.

Also, if it is necessary to use a certain hard-to-paint material, laying a covering material already painted on a base material to form an integral body will result in a suitable clad steel plate being obtained.

Furthermore, although a copper plate as a simple material, for example, can not be processed by laser, can be rendered capable of being processed by laser if it is combined with an iron plate. Also, as for plating process, too, a clad plate of, for example, copper and iron can get its iron-side surface plated with copper and present an appearance and characteristics as of a copper plate although an iron plate is used as material. Also, a material whose surface is otherwise difficult to treat by metal spray can be so treated easily if it is made into a clad plate.

This means that a material whose surface as a simple material is difficult to treat can turn into a material with an excellent surface-workability.

In addition, the present invention which enables the base and covering materials to be held together securely and fast without using a vacuum rolling offers a high production efficiency and a low production cost.

A clad steel plate according to claim 2 characterized in that an organic or inorganic cloth, paper or film is placed between the base material and the covering material will give the following effect:

A clad steel plate with an excellent heat barrier and heat insulation capacity can be obtained by placing an organic or inorganic cloth, paper or film between the base material and the covering material.

A clad steel plate according to claim 3 which comprises a nitrided base material with holes with rising rims and a covering material both held fast together by the rising rims passing through the covering material and expanding over its surface will give the following effect:

When the base material and the covering material are put together by rolling, the base material which is hardened by nitridation allows its rising rims to easily pass through the covering material.

A clad steel plate according to claim 4 characterized in that an organic or inorganic cloth, paper or film is placed between the base material and the covering material will give the following effect:

A clad steel plate with an excellent heat barrier and heat insulation capacity can be obtained by placing an organic or inorganic cloth, paper or film between the base material and the covering material.

| Description of the symbols | |
|---|---|
| 1 | Clad steel plate |
| 2 | Base material |
| 21 | Rising rims |
| 22 | Holes |
| 3 | Covering material |
| 5 | Organic or inorganic cloth, paper or film |

DETAILED DESCRIPTION OF THE INVENTION

The clad steel plate according to the present invention will be described below by reference to figures.

Figure 1:
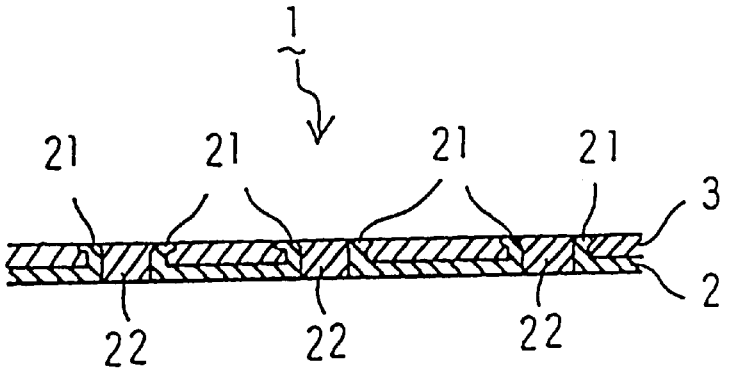
FIG. 1 is a sectional view showing an example of a clad steel plate relating to the present invention.
Figure 2:
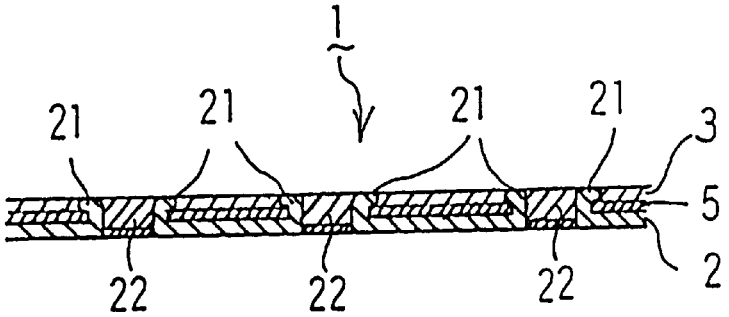
FIG. 2 is a sectional view showing another example of a clad steel plate relating to the present invention.

FIG. 1 is a sectional view showing an example of clad steel plate 1 according to the present invention.

The clad steel plate 1 according to the present invention comprises a base material 2 and a covering material 3 integrated with the base material.

The base material 2 has holes 22 with rising rims 21 and is nitrided. The rising rims 21 pass through the covering material 3 and expand over its surface so that the base material 2 and the covering material 3 are fitted together.

For the base material 2 and the covering material 3 it is possible to use any of generally known metals in general use for clad steel plates. For the base material 2 it is preferred to use such a steel as may contain elements facilitating the production of nitrides such as Cr, Mo, Al, Ti, V etc.. In concrete terms, we can cite stainless steel, steel for nitridation (Al-Cr-Mo steel) etc.

In the clad steel plate 1 according to the present invention it is even possible to adopt as the base material 2 a composition which is not nitrided, in which case we can cite as an appropriate example a composition using some soft metal like Fb, Zn etc. as the covering material 3 and a steel as the base material 2.

Even in a composition comprising the non-nitrided base material 2, neither the base material 2 nor the covering material 3 is limited to any particular material whatsoever as long as the base material 2 is harder than the covering material 3.

In the clad steel plate 1 according to the present invention it is possible to adopt a composition using an organic or inorganic cloth, paper or film 5 placed between the base material 2 and the covering material 3.

For the organic or inorganic cloth, paper or film 5 between the base material 2 and the covering material 3 it is possible to cite as a suitable example a glass fiber cloth, carbon fiber cloth, graphite paper, unwoven cloth of chemical fiber, synthetic resin film, ceramic paper etc.

Placing the organic or inorganic cloth, paper or film 5 between the base material 2 and the covering material 3 makes it possible to obtain a clad steel plate 1 adapted as such a product or component requiring a high heat barrier or insulation capacity as may be used in various fields including automobile parts such as engine head gasket or manifold gasket or parts of household articles such as water heater or air-conditioner etc.

As for other fields of application of the clad steel plate 1 according to the present invention, the clad steel plate which is provided with a large number of holes 22 can be used as sound-absorbing or -insulating material.

Besides, freely adjusting the thickness of the base material 2 and of the covering material 3 makes it possible to manufacture clad steel plates 1 not only of various total thickness but also of various ratios of thickness between the base material 2 and the covering material 3 by making the base material 2 thicker than the covering material 3 or the other way around, i.e. the base material 2 thinner than the covering material 3.

In addition, in the clad steel plate 1 according to the present invention, we can obtain materials with excellent workability in metallic mold even from aluminum or other unannealed materials which are otherwise liable to develop cracks during press forming in metallic mold by making a clad plate by combination with other materials. Moreover, although conventional pressings made of multiple materials have required a multiple number of pressing processes, the clad steel plate 1 according to the present invention need be pressed just once and as such will prove extremely advantageous even in terms of the efficiency and cost of production.

Besides, although it has been difficult to weld some particular materials with a certain other type of metal, laying an excellently weldable covering material on the surface of a base material now makes it easy to weld them together.

Also, if it is necessary to use a certain hard-to-paint material, laying a covering material already painted on a base material to form an integral body will result in a suitable clad steel plate being obtained.

Furthermore, although a copper plate as a simple material, for example, can not be processed by laser, can be rendered capable of being processed by laser if it is combined with an iron plate. Also, as for plating process, too, a clad plate of, for example, copper and iron can get its iron-side surface plated with copper and present an appearance and characteristics as of a copper plate although an iron plate is used as material. Also, a material whose surface is otherwise difficult to treat by metal spray can be so treated easily if it is made into a clad plate.

This means that a material whose surface as a simple material is difficult to treat can turn into a material with an excellent surface-workability.

Figure 3:
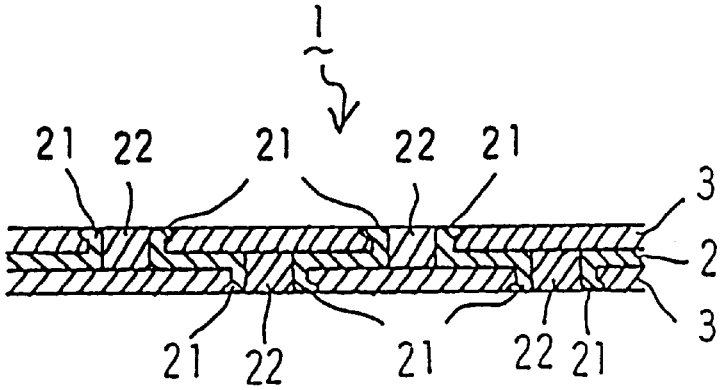
FIG. 3 is a sectional view showing an example of a clad steel plate relating to the present invention comprising 3 layers.
Figure 4:
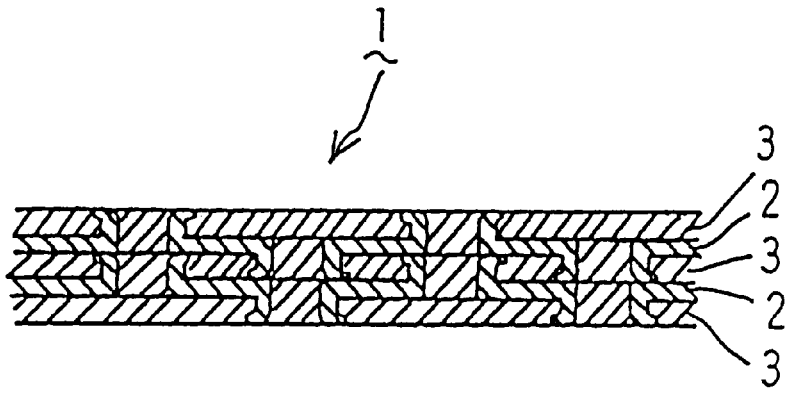
FIG. 4 is a sectional view showing an example of a clad steel plate relating to the present invention comprising 5 layers.

Another embodiment of the clad steel plate 1 according to the present invention is a composition of 3 layers realized by fitting the covering material 3 on each of both sides of the base material 2 as shown in FIG. 3 or a composition of 5 layers as shown in FIG. 4. It is even possible to adopt a composition of more than 5 layers.

Figure 5:
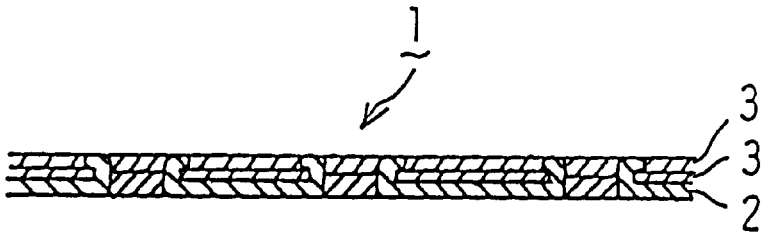
FIG. 5 is a sectional view showing an example of a clad steel plate relating to the present invention comprising 2 layers of a covering material.

Also, as shown in FIG. 5, one may just as well adopt a composition with plural layers of the covering material 3 on one side of the base material 2.

It goes without saying that in compositions as shown in FIG. 3 to 5, too, one may adopt a composition with an organic or inorganic cloth, paper or film 5 placed between the base material 2 and the covering material 3.

In the following we will describe an example of method of manufacturing the clad steel plate 1 according to the present invention.

Figure 6:
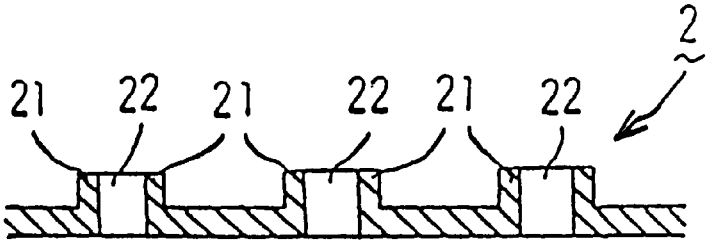
FIG. 6 is a sectional view showing an embodiment of a base material of a clad steel plate relating to the present invention.

First of all, as shown in a sectional view of FIG. 6, a base material 2 is provided with holes 22 with rising rims 21 by any of arbitrary processing methods including burring process. In this case, it is preferred to arrange such holes 22 staggered in the base material as shown in a plan view of FIG. 7 but this is not the only particular way allowed.

There is no particular restriction to the shape, number and size of the holes 22 in the base material which all can be set in any appropriate way so as to obtain a sufficient strength of cohesion between the base material 2 and the covering material 3.

Figure 7:
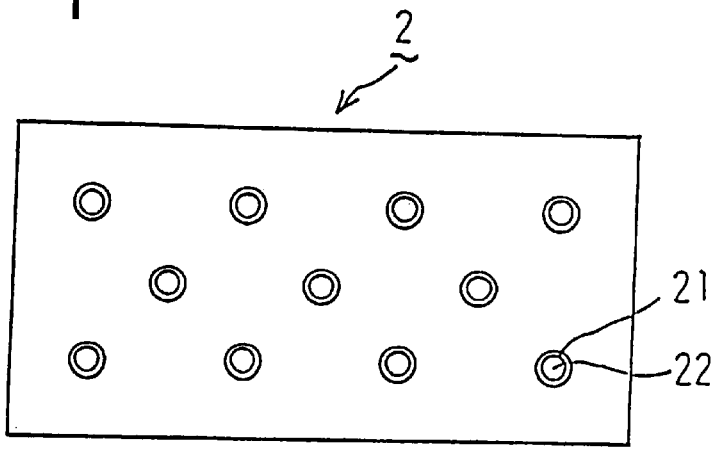
FIG. 7 is a plan view of an example of a base material of a clad steel plate relating to the present invention which is provided with holes.
Figure 8:
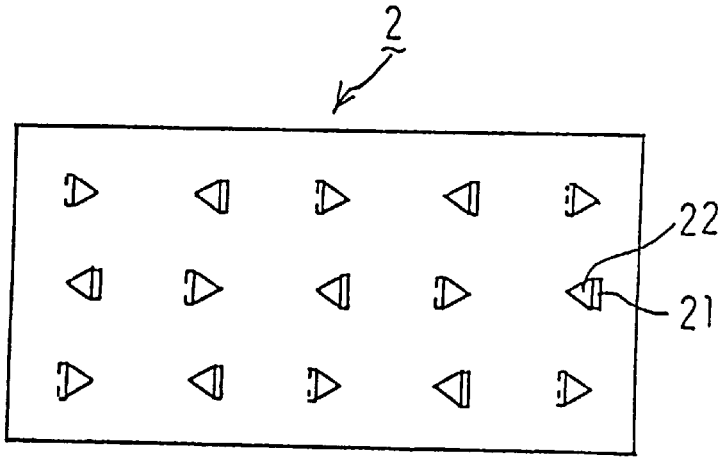
FIG. 8 is a plan view of another example of a base material of a clad steel plate relating to the present invention which is provided with holes.
Figure 9:
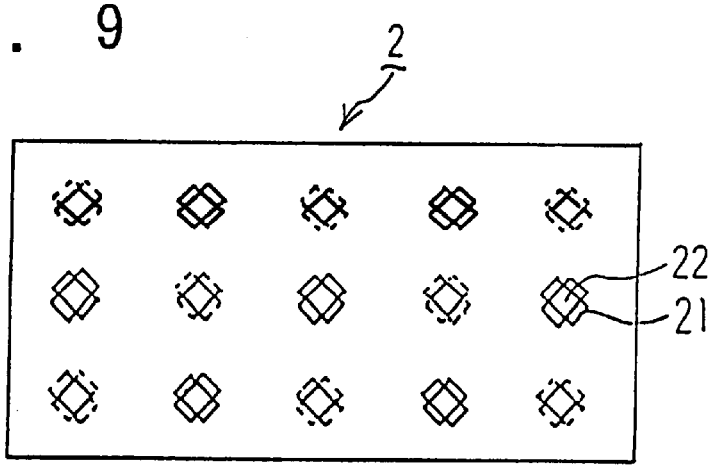
FIG. 9 is a plan view of still another example of a base material of a clad steel plate relating to the present invention which is provided with holes.

Other appropriate examples of shapes of the holes 22 in the base material are a "triangle" as shown in FIG. 8 or a "square" as shown in FIG. 9. FIG. 7 shows an example with the rising rims 21 arranged on one side only whereas FIG. 8 and 9 show an example with the same arranged on both sides.

Now, the base material 2 having the holes 22 with the rising rims 21 may be nitrided. One may just as well adopt the base material 2 which is not nitrided as described earlier.

A method of nitridation used may be one known to the public. Yet, it is even better to use the method described below.

Figure 10:
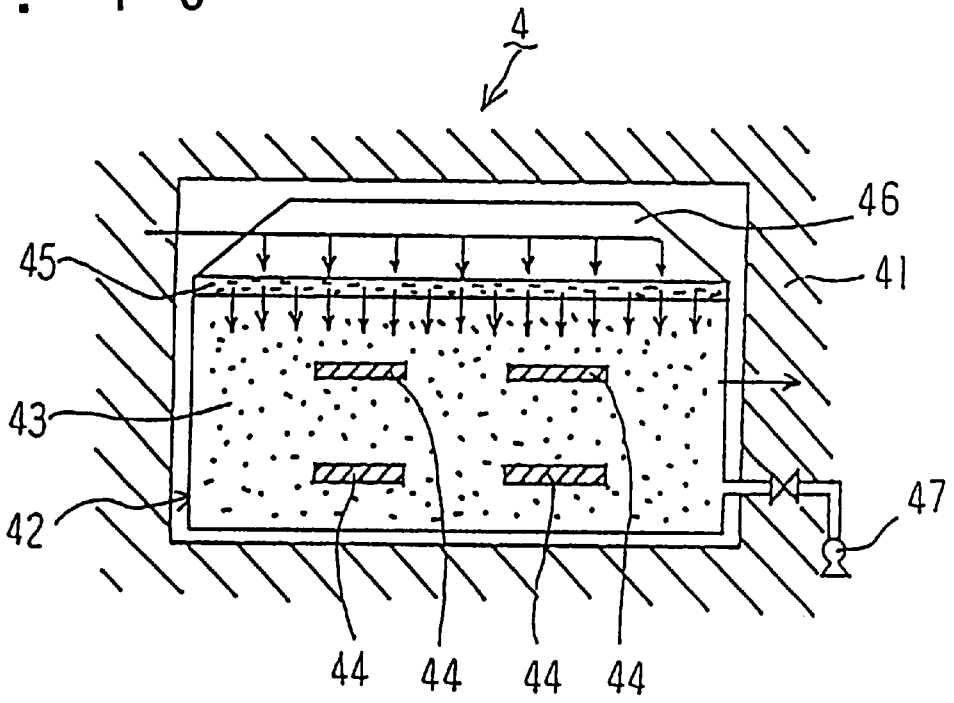
FIG. 10 is a model view showing an example of a nitridation device.

FIG. 10 shows a typical example of a device 4 used for nitridation.

The arrows in the figure indicate the flow of gas. 47 is a vacuum pump.

First of all, calcium cyanamide ($CaCN_2$) 43 is laid on the bottom of a chamber 42 set in a furnace 41, material to be treated (base material) 44 is laid on the top of it and then calcium cyanamide is spread once again now over the material. This process is repeated as many times as may be necessary according to the size of the chamber and the quantity to be treated, then the chamber 42 is vibrated. This enables even the narrow grooves and the long and narrow holes in the material 44 to be treated to be clogged properly with calcium cyanamide. A dispersion board 45 of ceramic wool is set on the top of the calcium cyanamide and a cover 46 with a small chamber called "dispersion chamber" is put. Then ammonia gas ($NH_3$) or a mixed gas of ammonia and of nitrogen or hydrogen (ratio of mixture: 1 ammonia: 0.2–2 nitrogen or 0.1–1 hydrogen) is once introduced into the dispersion chamber. The gas now evenly spread in the dispersion chamber begins to flow through a nozzle (not shown in the figure) installed at the bottom of the dispersion chamber into the chamber 42. At this time the gas passes through the ceramic wool and thus spreads evenly to facilitate the nitridation process.

The conditions for the nitridation process may be set as they are deemed proper according to the quality and specifications of the material to be treated. It is preferred to set the gas pressure at 0.1–0.4 MPa, the gas temperature at 430°–500° C. and the duration of treatment at 7–50 hours.

According to the nitridation process described above it is possible to achieve excellent effects including 1) evenly treating products of complicated shapes with, for example, narrow grooves and deep holes, 2) efficiently treating even stainless steel and nickel-based alloy which are said to be difficult to nitride by gas, 3) obtaining a large depth of nitridation, 4) obtaining a hard nitrided film, 5) easily setting the product, etc..

Unlike the conventional nitridation process using nitrogen produced by the decomposition of ammonia gas, the method described above forms a nitrided layer in the material being treated by nitrogen produced by a large partial pressure of nitrogen resulting from a thermal decomposition of calcium cyanamide that takes place under an extremely low partial pressure of oxygen. The nitrogen then produced by the decomposition of ammonia gas is used to make up the one taken away from calcium cyanamide by the nitridation process. This means that this nitridation process takes place while the decomposition and production of calcium cyanamide are repeated.

Consequently, according to this nitridation method it is possible to evenly nitrify the material of a complicated shape being treated due to the calcium cyanamide which is brought in contact with the material evenly by the vibration given while the material is set.

Figure 11:
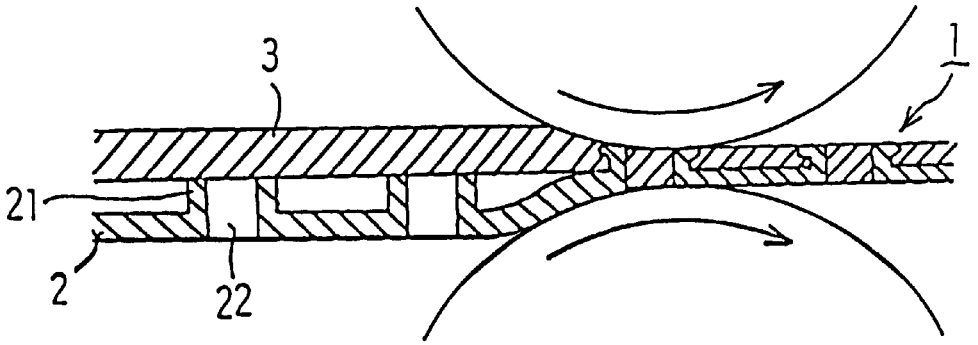
FIG. 11 is a view for explaining a process of manufacturing a clad steel plate relating to the present invention.

After nitriding the base material 2 as described above, a covering material 3 is laid on it and the both materials are rolled together so that rising rims 21 of the base material 2 pass through the covering material 3 and expand over its surface (see FIG. 11). This will result in the base material 2 and the covering material 3 being united in one body as the clad steel plate 1 as shown in FIG. 1.

During the rolling process, the rising rims 21 of the base material 2 which has been hardened to a Vicker's hardness of Hv900–1100 by nitridation can easily pass through the covering material 3.

If a non-nitrided material is used as the base material 2, then it suffices to use the covering material 3 which has a lower hardness than the base material 2.

It goes without saying that if a composition is adopted in which an organic or inorganic cloth, paper or film 5 is placed between the base material 2 and the covering material 3, then it suffices to do this placement before rolling.

It is preferred to do rolling a few times to gradually reduce the material up to a necessary thickness.

Any rolling method known to the public such as hot rolling or cold rolling will prove appropriate for a clad steel plate.

We claim:

1. A clad steel plate comprising a metal base material and a metal covering material attached to the base material manufactured by forming holes with rising rims in the base material, covering the base material with the covering material, rolling the base material with the covering material, and uniting the base material with the covering material to adhere each other throughout by passing the rims through the covering material and expanding the rims over the surface of the covering material.

2. A clad steel plate comprising a metal base material and a metal covering material attached to the base material manufactured by forming holes with rising rims in the base material, nitriding the base material, covering the base material with the covering material, rolling the base material with the covering material, and uniting the base material to adhere to each other throughout the covering material by passing the rims through the covering material and expanding the rims over the surface of the covering material.

* * * * *

UNITED STATES PATENT AND TRADEMARK OFFICE

CERTIFICATE OF CORRECTION

PATENT NO. : 5,910,377

DATED : June 8, 1999

INVENTOR(S) : Katsuro Tzukamoto, et al.

It is certified that error appears in the above-indentified patent and that said Letters Patent is hereby corrected as shown below:

ON THE TITLE PAGE:

After Item [22], please insert the following:

[30] Foreign Application Priority Data

April 11,1996 Japan.....8-115649

Signed and Sealed this

Fifth Day of October, 1999

*Attest:*

*Attesting Officer*

Q. TODD DICKINSON

*Acting Commissioner of Patents and Trademarks*